US005284326A

United States Patent [19]

Chiovitti et al.

[11] Patent Number: 5,284,326

[45] Date of Patent: Feb. 8, 1994

[54] RESILIENT ROAD-GUARD POST, AND METHOD OF MANUFACTURE THEREOF

[76] Inventors: Domenico Chiovitti, 627, Paul Émile Victor, Boucherville, Quebec, Canada, J4B 6W4; Pierre Blanchard, 57, Lindor Street, Granby, Québec, Canada, J2G 8C8

[21] Appl. No.: 944,256

[22] Filed: Sep. 14, 1992

[51] Int. Cl.[5] ..... E01F 15/00

[52] U.S. Cl. ..... 256/13.1; 404/10; 256/1; 29/403.1; 29/433

[58] Field of Search ..... 256/13.1, 19; 404/9, 404/10; 29/403.1, 403.3, 433; 114/219; 267/140; 104/254, 249

[56] References Cited

U.S. PATENT DOCUMENTS

| | | | |
|---|---|---|---|
| 2,649,295 | 8/1953 | Schuyler | 267/140 |
| 3,014,710 | 12/1961 | Layne | 267/140 |
| 3,838,492 | 10/1974 | Uemura | 29/403.3 |
| 3,928,701 | 12/1975 | Roehner | 114/219 |
| 3,951,384 | 4/1976 | Hildreth | 404/9 |
| 3,975,916 | 8/1976 | Watson | 114/219 |
| 4,030,706 | 6/1977 | Ward . | |
| 4,057,141 | 11/1977 | Laurie | 114/219 |
| 4,186,913 | 2/1980 | Bruner . | |
| 4,288,061 | 9/1981 | Moreau | 256/13.1 |
| 4,355,754 | 10/1982 | Lund | 256/13.1 |
| 4,847,976 | 7/1989 | Winkler | 29/433 |
| 5,086,552 | 2/1992 | Moore | 29/403.1 |
| 5,156,486 | 10/1992 | Davidson | 29/403.1 |

FOREIGN PATENT DOCUMENTS

| | | | |
|---|---|---|---|
| 2950699 | 7/1981 | Fed. Rep. of Germany | 256/13.1 |
| 2460365 | 2/1981 | France | 256/13.1 |
| 618488 | 7/1980 | Switzerland | 256/13.1 |

*Primary Examiner*—Randolph A. Reese
*Assistant Examiner*—Anthony Knight
*Attorney, Agent, or Firm*—Pierre Lespérance; Francois Martineau

[57] ABSTRACT

The ground anchored post is made exclusively from the steel-belted treads and metallic wire rings of reclaimed, used, pneumatic tires. Each used tire is cut with a shearing tool to remove therefrom the rubber side walls thereof. A selected number of treads are then compressed flatly against one another, while a plurality of wire rings engage by their hollow the compressed pack of treads. The total number of treads selected is a function of the thickness of each tread and of the diameter of the tires, whereby the number of treads is high enough to provide taut, friction-fit engagement of the wire rings around the pack of treads. The taut engagement of wire rings around the pack of treads positively prevents the treads from engaging in sliding displacement relative to one another.

7 Claims, 4 Drawing Sheets

RESILIENT ROAD-GUARD POST, AND METHOD OF MANUFACTURE THEREOF

FIELD OF THE INVENTION

This invention relates to the use of tires as guard rail posts.

BACKGROUND OF THE INVENTION

It is now a required safety measure to provide guard rail bumper guards in pronounced curbs along motor vehicle highways, to prevent these vehicles from falling into ditches. Some of these road guards have desirably been made from spring-back, elastic components that will provide some measure of yield under the vehicle load, while "rebounding" the vehicle on the road thereafter. A number of patents have issued in this particular field, for example U.S. Pat. No. 4,030,706 dated Jun. 21, 1977 in the name of James S. WARD. In this patent, a pair of automobile tires are arranged concentrically one within the other is with their central mouth engaged therethrough by a rail bumper guard, transversely to its longitudinal axis. Such arrangement is of course crude (as seen in FIG. 1 of the Ward patent), and is of overall low impact absorbing capability.

In U.S. Pat. No. 4,186,913 issued Feb. 5, 1980 to A. Bruner et al , the road guard includes a plurality of uprightly disposed, used, pneumatic tires 8, supported by and embedded into a reinforced resilient base. This traffic divider is used both as a resilient bumper as well as a road divider or safety rail. Hence, when the barrier is used as a safety divider alongside a road, a vehicle striking this barrier would be diverted with minimum damage back on the roadway.

A tire is a pneumatic structure, of generally toroidal shape, for encircling the wheels of a road-going vehicle. A tire conventionally includes a radially outward, road surface engaging tread, a pair of opposite, radially inward, wheel rim engaging, annular wires, and a pair of side walls integrally joining the tread (via a pair of opposite annular beads) to the pair of wires. The discrete external covering of synthetic rubber (the tread) is reinforced with a steel belt and fabric ply, laminated against the interior face of the tread. The tire further defines a radially inward, annular mouth, forming the gap separating the two wires, for through passage of the inflatable, cushioning inner tube. The wires and steel belt are embedded into the synthetic rubber of the tire.

Most current passenger car tires have an overall diameter ranging from about 60 to 75 centimeters (cm), such tires constituting the overwhelming bulk of the used tire market. This in turn means that the developed length of any given tire tread would then range approximately from 190 to 235 cm ($3.141592 \times 60$ to 75).

It is understood that a so-called "used" tire is a tire whose tread thickness has been substantially reduced by road-borne frictional forces, up to a point where efficient road surface contact by the tire is compromised in such a way that hazardous road-going conditions appear. That is to say, the remaining tire components usually retain substantially all their original performance features, including the steel belt and the metallic wires.

Such use of used tires as impact absorbers on road guards is all the more desirable, in that current methods of tire recycling are not cost-effective. Indeed, the tire recycling end product, usually rubber powder, cannot be sold at a competitive price, because the cost in manpower and particularly in energy requirements to transform the tire into powder—including separation of the steel wires and steel belt from the rubber material proper—exceeds the market price for such rubber powder. Government subsidies are therefore a prerequisite for such business endeavours.

Currently, the used tire reclaiming process operates in three main steps, each representing about a third of the reclaiming costs to the recycling plant operatór:

(a) slashing the tire into shreds;

(b) setting apart the steel from the rubber;

(c) transforming the rubber shreds into a granular compound, by grinding same into a fine powder.

OBJECTS OF THE INVENTION

The gist of the invention is therefore to improve upon existing road guards having components providing impact-absorbing, spring-back properties, whereby a swaying vehicle can be diverted back to the roadway with minimum damage.

A corollary object of the invention is to reclaim in a cost-effective, environmental-friendly fashion the huge number of used tires generated by passenger car vehicle owners, and particularly the metallic wire and belt parts of the tire.

SUMMARY OF THE INVENTION

Accordingly with the objects of the invention, there is disclosed a post structure for use as a ground driven anchor member for a road guard, said post structure consisting exclusively of separated, used tire components, namely, from: (a) a selected number of developed, elastomeric tire treads, to be flatly compressed against one another in an elongated, generally rectangular flat pack of treads; (b) a plurality of annular tire wire rings, surroundingly engaging said plurality of compressed treads; said number of treads being selected as a function of tread thickness and tire diameter, whereby said number of treads is high enough to provide taut, friction-fit engagement of said wire rings around said pack of treads, said taut engagement of wire rings around said pack of treads positively preventing said treads from sliding displacement relative to one another; wherein each said tread and each said wire includes a full length, metal-like, rigid core and a rubber like sheath into which the rigid core is embedded; said post imparting resilient, impact-absorbing rigidity to the road guard, while boasting spring-back capability under lateral blow, whereby a vehicle striking this road-guard would be diverted with minimum damage back on the roadway.

The invention is also directed at a method of manufacturing road guard, ground-driven, support posts from reclaimed, used, pneumatic tires, each said tire of the type defining a steel-belted elastomeric tread, a pair of wire rings and a pair of side walls; the method comprising the following steps: (a) cutting with a shearing tool the tire side walls from the remaining components of the tire; (b) submitting the tire treads to grinding action from a grinding machine, to transform the arcuately-shaped tread into a flat, quadrangular shape; (c) superimposing a selected number of said treads over one another, to form a tread pack; (d) progressively compressing the elastomeric treads pack with a press machine, along one side of said quadrangular treads; (e) engaging the hollow of a selected number of said wire rings through the treads pack; and (f) releasing the press machine.

DETAILED DESCRIPTION OF THE INVENTION

Figure 1:
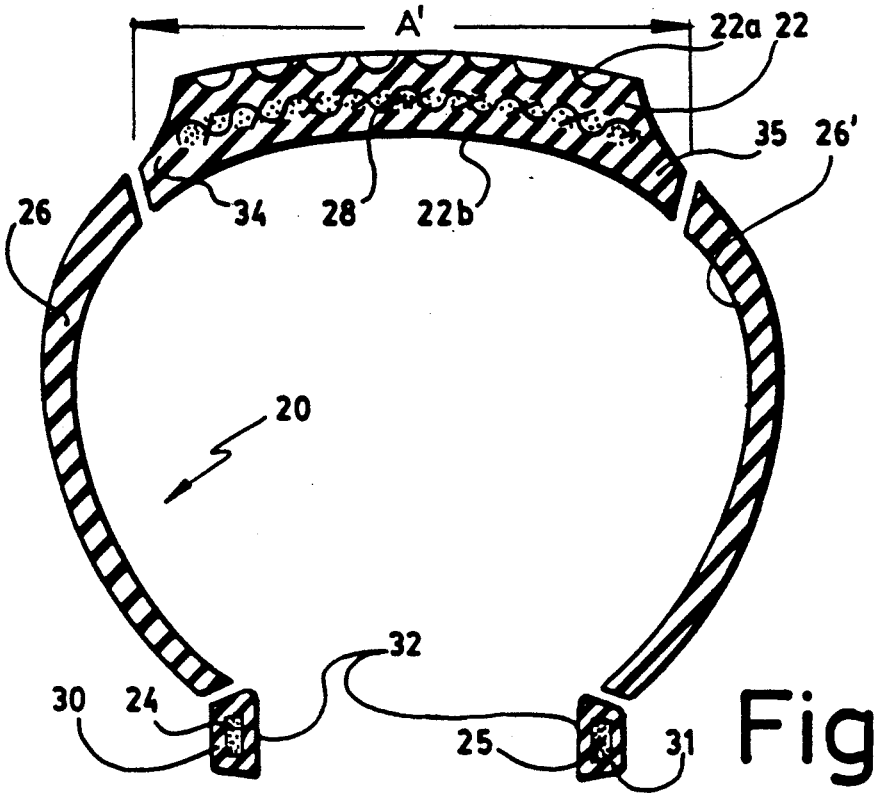
FIG. 1 is a cross section of a conventional - but worn-out tire.

Conventional tire 20 is illustrated in cross-section in FIG. 1, being understood that the tire is toroidal in its three dimensional shape. Tire 20 defines a radially outward, flat rubber tread 22, a pair of spaced, radially inward, metallic wires 24, 25, and a pair of arcuate rubber side walls 26, 26' integrally joining the tread 22 to the wires 24 and 25. A reinforcing steel belt 28 is embedded into tread 22 radially inwardly of the tread road-engaging free surface 22*a* but radially outwardly of the rubber tread interior section 22*b*. Each wire 24, 25 is also completely embedded into a rubber sheath 30, 31 merging with the radially inward edge of tire walls 24, 25. The two wires 24, 25 are spaced by an annular gap or mouth 32 by a distance or width smaller than the width of tread 22.

According to the invention, each tire side wall 26, 26' is cut with a suitable shearing tool at the radially inward and outward edges thereof, and then discarted. Thus, there remains three tire components:

(a) first and second wire loops, including their rubber sheaths 24, 30 and 25, 31; and (b) the tread 22, including a thin remaining rubber layer 22*a* on one face thereof, an opposite rubber layer 22*b*, and a pair of opposite, thicknesswisely tapering, edgewise lips 34, 35 about which merge rubber layers 22*a* and 22*b* exclusively of steel belt 28.

Figure 2:
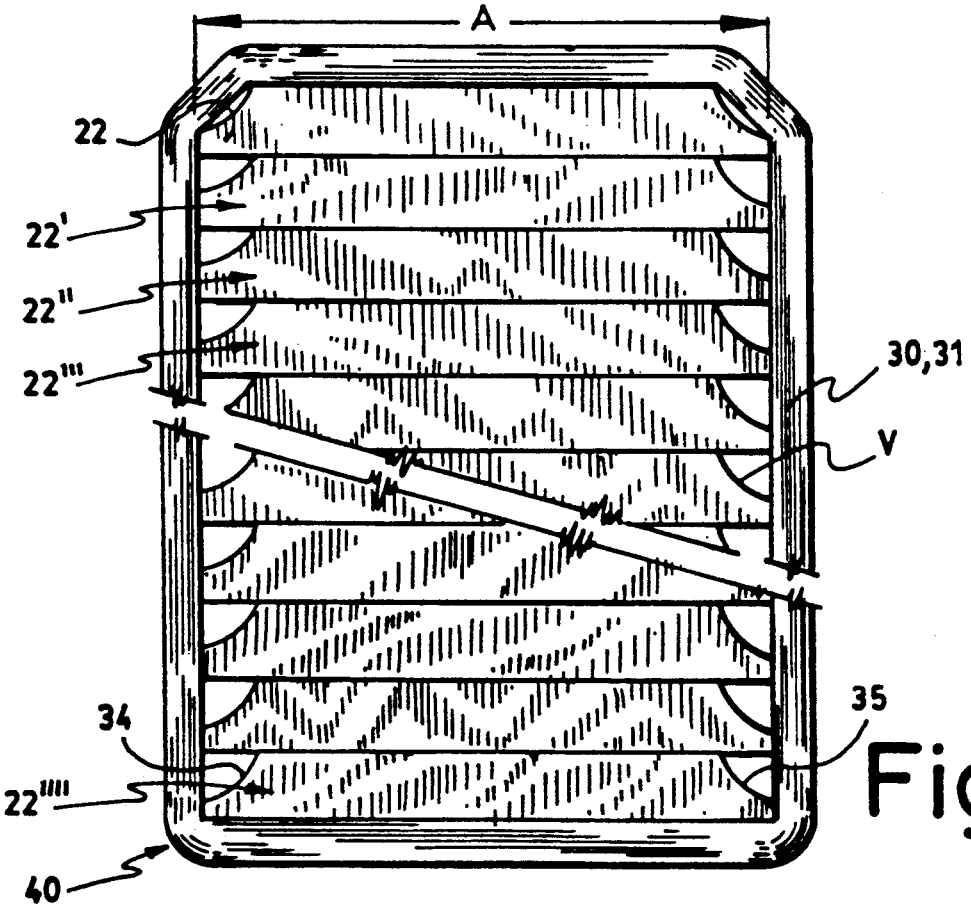
FIGS. 2 and 4 are a broken plan view and plan view respectively of the a beam or post of the invention, made from tire components illustrated in FIG. 1.

As suggested in the end view of FIG. 2, a plurality of elastomeric treads 22, 22', 22'', 22''', . . . from tires 20 of identical sizes, are flatly compressed against one another to form a multilayer sheet structure of a length of about two meters (as discussed in the Background of the invention paragraph, supra) , and a width equal to the distance between lips 34 and 35 of any one of the identical size tires.

The total number of treads 22 to be compressed against one another is a function of the thickness of each tread 22 and of the length of the selected wire-reinforced rubber loop 30. A number of loops 30, 30', 30'', . . . engage transversely the pack of superimposed treads 22, and each successive pair of loops are spaced from one another by a selected spacing interval S, as suggested in FIG. 3. Each loop 30 (or 31, interchangeable), is to engage the top face 22*a* of the uppermost tread 22, the free ends of all the lips 34 and 35, and the bottom face 22*b* of the lowermost tread 22''''. The total number of treads 22 is selected so that the surrounding loops 30 remain taut therearound to prevent lengthwise relative sliding displacement of one tread relative to the other treads.

It is understood that the tread and loop structure in end view in FIG. 2, will be rectangular, since each loop 30, measuring slightly less than two meters in developed length (a tread 22 measuring slightly more than two meters on average), will be able to attach a large number of treads, for example between 25 and 35 treads 22, due to the fact that the width of the tread 22 (the distance between lips 34 and 35) is relatively small, e.g. between 15 and 20 cm.

Figure 3:
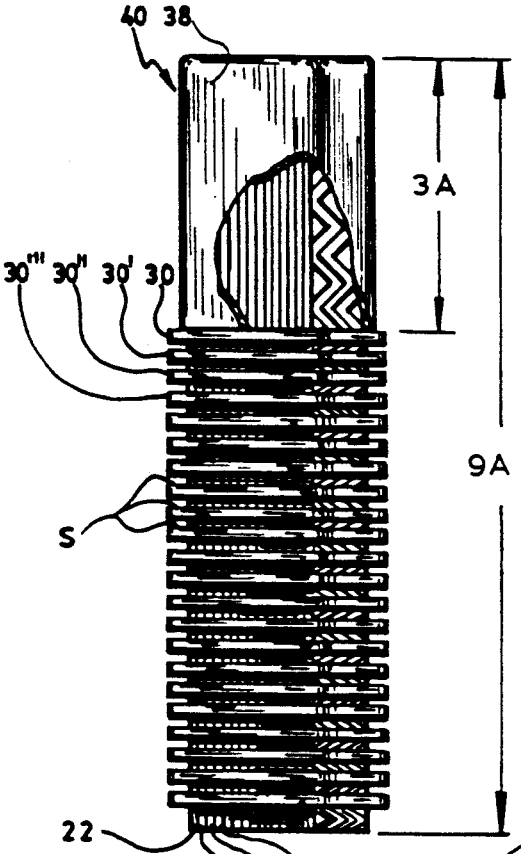
FIGS. 3 and 6 are elevational views of a beam of the invention, the beam being embedded into ground in FIG. 6.
Figure 4:
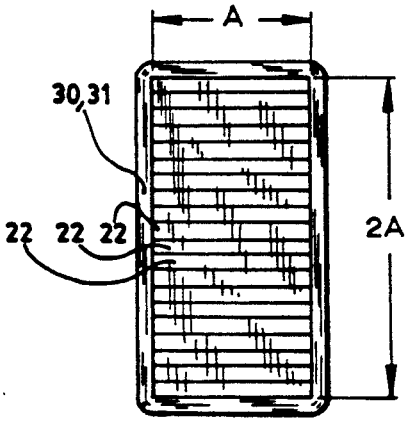
Figure 5:
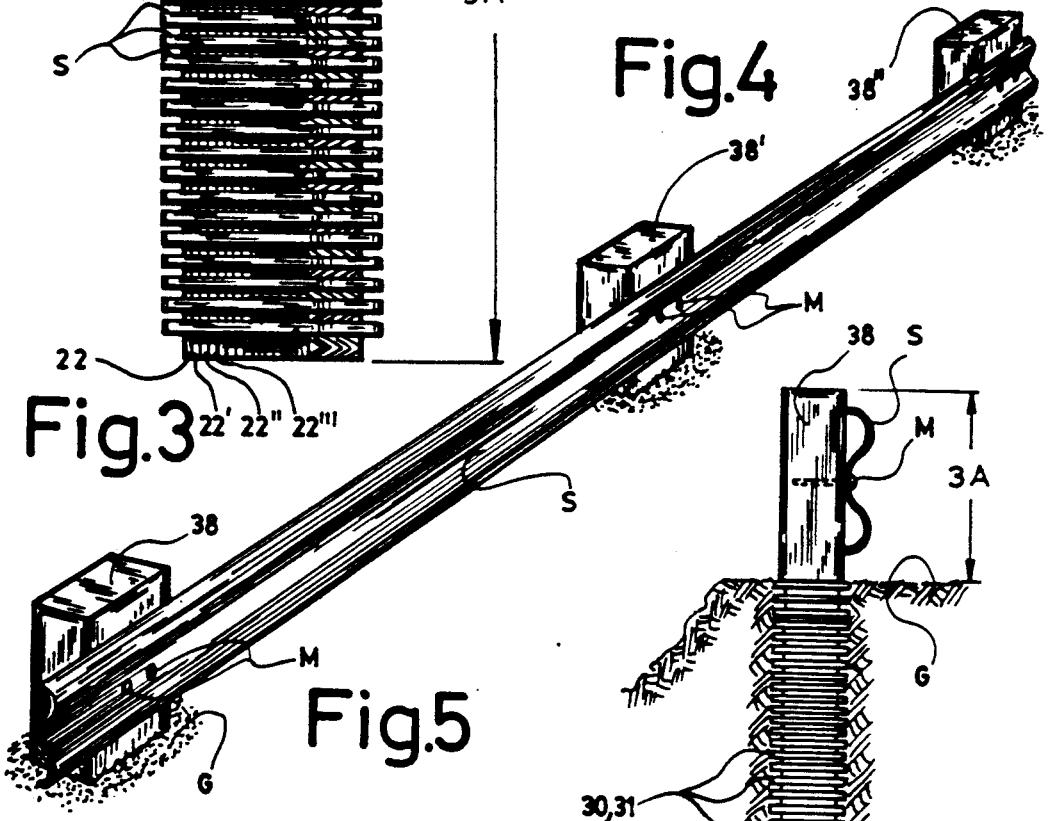
FIG. 5 is an isometric view of a road guard or barricade secured to the ground driven post of the invention.
Figure 6:
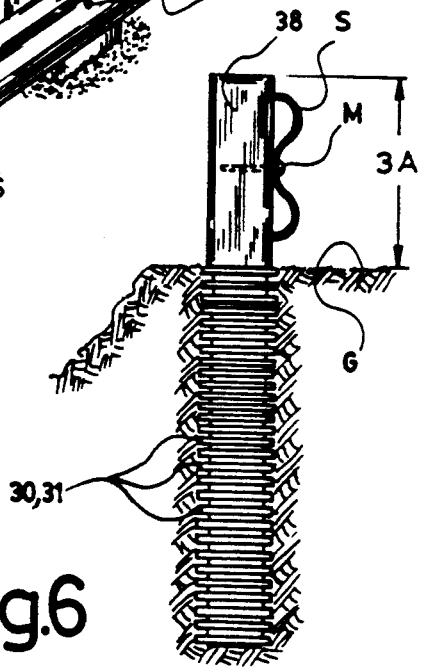
Figure 9:
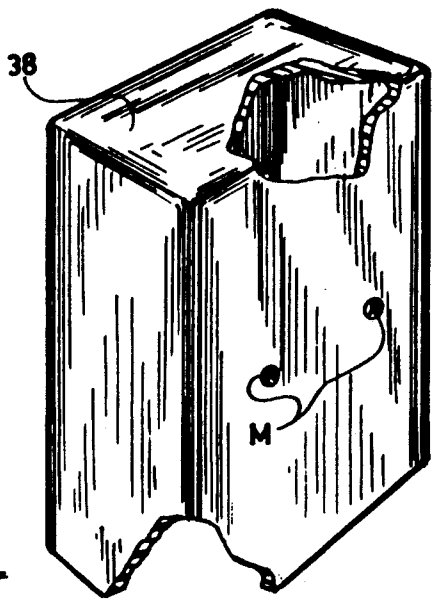
FIG. 9 is a partly cut away view of the top end casing or covering cap of FIGS. 7 and 8.

In the embodiment of road-guard post construction shown as 40 in FIG. 3, a plurality of loops 30, 30', 30'', 30''', . . . extend horizontally around the lower portion of a plurality of ground embedded, vertically mounted treads 22, 22', 22'', 22''', . . . while the upper end portion of treads 22 is left free of loops 30 for engagement by a weather proof, box-like cover 38 (e.g. made from a plastic material). Obviously, it would also be alternately possible, within the scope of the present invention, to extend the loops 30 up to the top edge of the pack of treads 22, whereby the box-like cover 38 would still engage around the upper portion of the treads 22 but then also enclosing the loops 30 of the upper layers. As illustrated in FIG. 5, these covers 38, 38', 38'', project outwardly upright over ground G, at spaced intervals. A conventional road guard metal sheet strip S is supported over ground in horizontal fashion by screw means M anchoring strip S to covers 38, 38', 38''.

Of course, the orientation of posts 40 could be changed accordingly with the required impact absorbing capability thereof, as a function of the intensity of the road curb, of the type of expected road traffic (small passenger vehicle or heavy transport trucks), et al.

Figure 8:
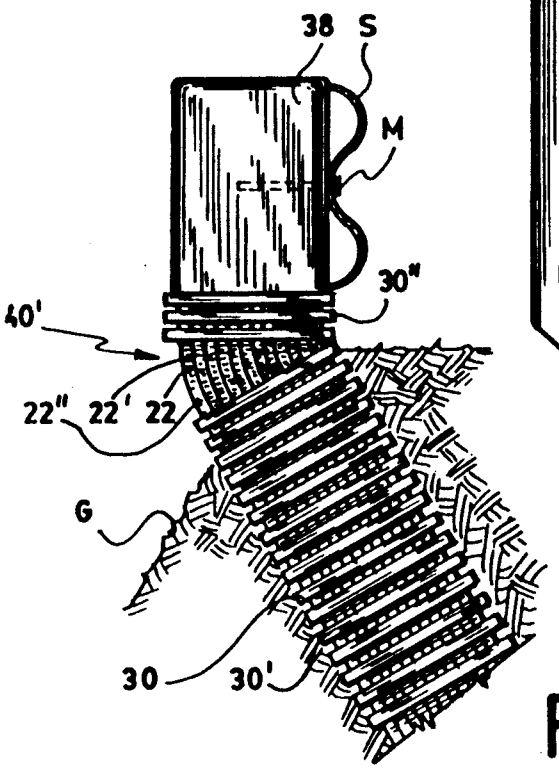
FIGS. 7–8 are elevational views of alternate embodiments of beams of the invention.
Figure 7:
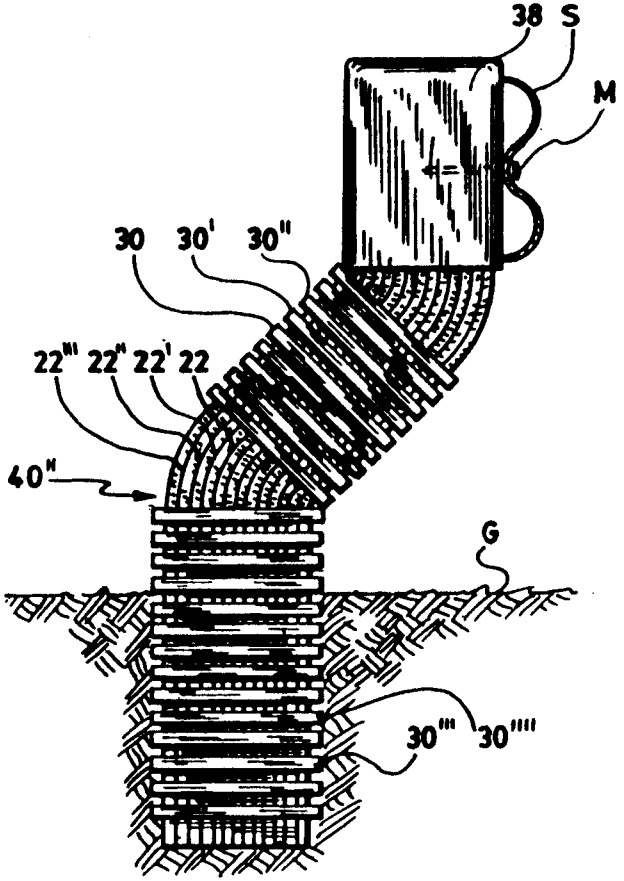

As suggested in FIGS. 7–8, treads 22, 22', . . . need not be necessarily compressed in straight fashion, but the tread pack of post 40 could be single elbowed (FIG. 8) at 40', or double elbowed (FIG. 7) at 40''. The elbow junction of elbowed posts 40' and 40'' must be free of wire rings 30. Such elbowing of the post 40' or 40'' is desirable in some cases, e.g. when ground surface is inclined as on a ditch (FIG. 8) or when an offset is required because of ground obstacles (FIG. 7), whereby the top cover 38 always extends vertically. Since post 40'' in FIG. 7 defines an undulating body inclined generally upwardly inwardly toward the road itself, it also has the added advantage of preventing road swaying vehicles from running over the top of the road guard.

FIGS. 10–13 are provided to show that alternate arrangements of treads 22, 22', . . . within wire rings 31, 31', are also envisioned.

Figure 10:
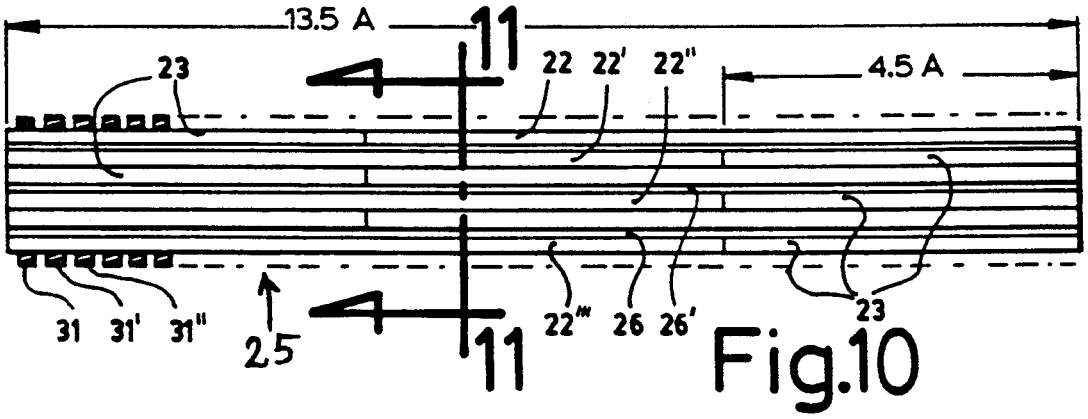
FIG. 10 is an edge view of a post of the invention.
Figure 11:
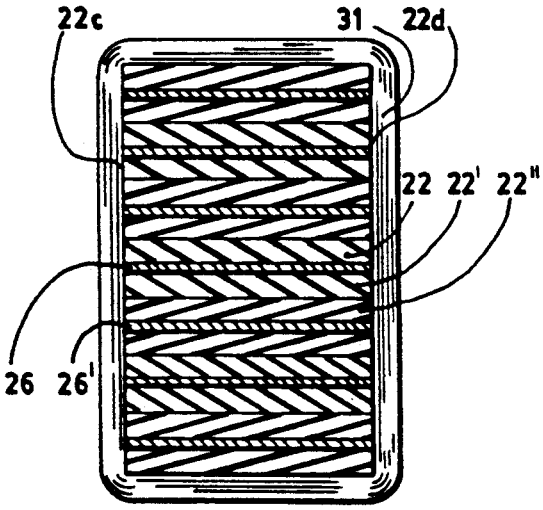
FIGS. 11–13 are cross-sections of three embodiments of posts similar to that of FIG. 10.

In the post embodiment 40''' of FIGS. 10–11, tread lips 34 and 35 are further sectioned and completely removed, so that rectangular ring 31 will abut flatly against the flat transverse, opposite, end edges 22*c*, 22*d* of each thus rectangular tread 22. This is different from post 40 in FIG. 2, where a small pocket or void V was created at the level of each lip 34 or 35, being located between registering portions of walls of each successive pair of treads 22, 22' and of wire ring 30 . Moreover, in posto 40''', tire side wall 26 or 26' could also be used as space sheet between two pairs of developed treads 22, 22' and 22'', 22''', being taken in sandwich therebetween and compressed therewith.

Figure 12:
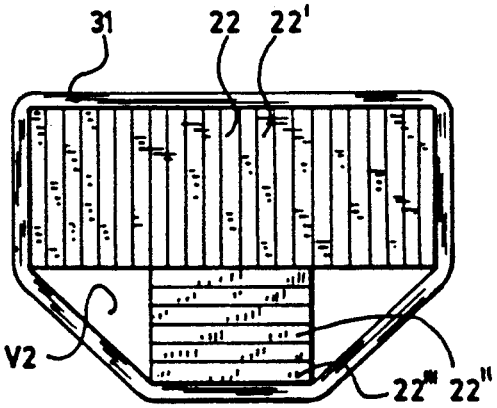

In FIG. 12, the post configuration, rather than being rectangular in cross-section as in the two prior embodiments, is now an irregular hexagon. This shape is achieved by adding a few superimposed layers of treads 22'', 22''', . . . transversely of the main pack of treads 22, 22', . . . intermediately its length. Thus, two large voids V2 are obtained within the volume circumscribed by wire rings 31, but since rings 31 will remain taut at all times due to the bias exerted by the full number of treads 22.

Figure 13:
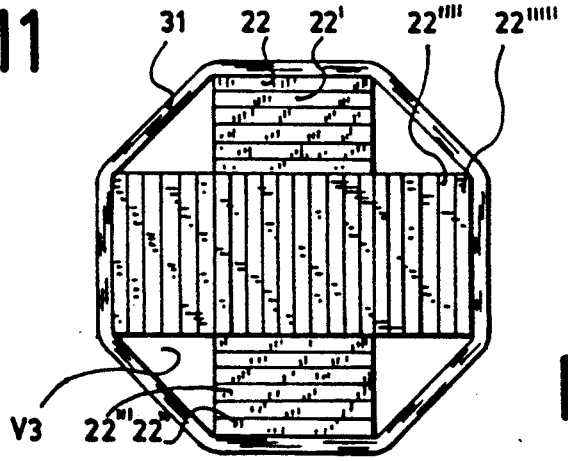

FIG. 13 shows a cross-sectionally octogonal guard rail post, having two sets of opposite, coplanar, transverse packs of treads 22, 22', . . . and 22'', 22''', . . . maintained taut against the long side edges of the main pack of treads 22'''', 22'''41, . . . Four large corner voids V3 are therefore created within the volume circumscribed by octogonal rings 31.

It is understood that the present posts could have alternate uses, for example as a ground tie for railways as illustrated in FIGS. 10–11 of the drawings. Such ties 25 (FIGS. 10–11) are longer than ordinary guard rail posts, and thus, the treads 22 are extended by half treads 23. Half treads 23 consist of treads 22 cut in half in alternating rows. Reference 26 indicates reinforcing steel bands, to reinforce against flexion of the ties 25. Also, diametrally larger posts—circumscribing a larger number of treads—could be manufactured, by attaching two or more wire rings 31, 31 in end-to-end abutment thanks to tie means. Such tie means could consist of cord-like elements (not shown) made from rubber parts reclaimed from the tire side walls 26, these cord-like elements engaging through registering end bores made through the end portions of rectangular treads 22 from the pack of treads.

The side walls 26, 26' are not normally used within post 40, and so can be ground to rubber powder for recycling. Since no steel-rubber interface exists in side walls 26, 26', the separation step normally required for tire recycling is therefore alleviated, thus substantially reducing the recycling cost to a level making the rubber powder manufacturing cost competitive on the market. Hence, the rubber reclaiming method consists of only two main steps, compared to the prior three step process outlined in the Background of the invention paragraph (supra):

(a) cutting with a shearing tool the tire side walls from the remainder of the tire; and (b) transforming the tire rubber side walls (which do not include any steel material) into fine powder by grinding.

The latter method is much more efficient than the former method, since not having to slash into shreds the tires saves substantial amounts of variable operating costs (energy requirements) and capital costs (slashing machinery).

With respect to the method for manufacturing the road guard post of the invention, it can be divided into five main steps (occuring after step (a) but before step (b) hereinabove):

(aa) submitting the tire treads 22 to grinding action by a grinding machine, to transform the arcuately-shaped tread into a flat, rectangular shape;

(ab) superimposing a selected number of said rectangular treads 22 over one another, to form a tread pack;

(ac) progressively compressing the elastomeric treads pack with a press machine, lengthwisely of the rectangular treads;

(ad) engaging the hollow of a selected number of rings 30 through the treads pack, as the press machine; and (ae) releasing the compressive force from the press machine.

CROSS-REFERENCE DATA

This application is filed following a Disclosure Document filing on Jan. 28, 1991, under No. 272447.

I claim:

1. A post structure for use as a ground driven anchor member for a road guard, said post structure consisting exclusively of pneumatic tire components, comprising:

(a) a selected number of developed tire treads, flatly compressed against one another in a generally quadrangular, flat pack of treads;

(b) a plurality of tire wire rings, surroundingly engaging said treads pack transversely thereof;

said-number of treads being selected in such a way that said number of treads is high enough to provide taut, friction-fit engagement of said wire rings around said pack of treads, said taut engagement of wire rings around said pack of treads positively preventing said treads from sliding displacement relative to one another within said wire rings;

wherein each said tread and each said wire ring includes a full length, rigid core and a sheath into which the rigid core is embedded;

said post structure imparting both substantial sturdiness yet resilient, impact-absorbing property to the road guard, while boasting spring-back capability under a lateral blow, whereby a vehicle striking this road-guard would be diverted with minimum damage back on the roadway.

2. A post structure as defined in claim 1, further including a weatherproof cover cap, covering the upper end of said post structure, said post structure upper end being free of said wire rings.

3. A post structure defined in claim 1, further including at least one additional set of selected number of second, superimposed, quadrangular tire treads, said second set of treads also compressed into a second pack of treads, said second pack of treads being positioned transversely of and edgewisely against the first- mentioned pack of quadrangular treads, the total number of said selected number of treads from said first and second pack of treads being such that each said wire ring surroundingly engages in taut, friction-fit fashion both said packs of treads.

4. A post structure as in claim 1, wherein said pack of treads define an intermediate portion bent to form an elbowed portion, said wire rings clearing said post structure elbowed portion.

5. A post structure as in claim 1, wherein said pack of treads has an undulating shape, defining two spaced elbowed portions, said wire rings clearing each said elbowed portion.

6. A method of manufacturing road guard, ground-driven, support posts from reclaimed, used, pneumatic tires, each said tire of the type defining a steel-belted elastomeric tread, a pair of wire rings and a pair of side walls; the method comprising the following steps:

(a) cutting with a shearing tool the tire side walls from the remaining components of the tire;

(b) submitting the tire treads to grinding action from a grinding machine, to transform the arcuately-shaped tread into a flat, quadrangular shape;

(c) superimposing a selected number of said treads over one another, to form a tread pack;

(d) progressively compressing the elastomeric treads pack with a press machine, along one side of said quadrangular treads;

(e) engaging the hollow of a selected number of said wire rings through the treads pack; and (f) releasing the press machine.

7. A post manufacturing process as defined in claim 6, further including the following step:

(g) transforming the tire side walls into fine powder by grinding.

* * * * *